US009794987B2

(12) United States Patent
Hung et al.

(10) Patent No.: US 9,794,987 B2
(45) Date of Patent: Oct. 17, 2017

(54) ADAPTIVE ELECTROTHERMAL SYSTEM AND ELECTROTHERMAL APPAREL

(71) Applicants: Yuen Hung, Causeway Bay (HK); Ho Man Sum, Causeway Bay (HK)

(72) Inventors: Yuen Hung, Causeway Bay (HK); Ho Man Sum, Causeway Bay (HK)

( * ) Notice: Subject to any disclaimer, the term of this patent is extended or adjusted under 35 U.S.C. 154(b) by 534 days.

(21) Appl. No.: 14/526,758

(22) Filed: Oct. 29, 2014

(65) Prior Publication Data

US 2015/0122791 A1 May 7, 2015

Related U.S. Application Data

(60) Provisional application No. 61/896,709, filed on Oct. 29, 2013.

(51) Int. Cl.
*H05B 1/00* (2006.01)
*H05B 1/02* (2006.01)

(52) U.S. Cl.
CPC ..... *H05B 1/0272* (2013.01)

(58) Field of Classification Search
CPC ..... H05B 1/0272; H05B 3/34; H05B 3/342; H05B 3/345; H05B 3/347; H05B 3/36; H05B 3/145; H05B 2203/003; H05B 2203/004; H05B 2203/005; H05B 2203/007; H05B 2203/008; H05B 2203/036; H05B 2214/04; H02M 1/08; H02M 1/44; H02M 1/32; H02M 2001/0009
See application file for complete search history.

(56) References Cited

U.S. PATENT DOCUMENTS

2017/0099011 A1* 4/2017 Freeman ..... H02M 7/06
2017/0133842 A1* 5/2017 Freeman ..... H02J 1/00

* cited by examiner

*Primary Examiner* — Shawntina Fuqua

(57) ABSTRACT

An adaptive electrothermal system and an electrothermal apparel are provided. The adaptive electrothermal system comprises a controller, a step-down regulator, a power controller and a load. An input of the controller is configured to receive an input voltage, a first output of the controller is configured to output an input voltage higher than an operating voltage of the load to the step-down regulator, a second output of the controller is configured to output an input voltage lower than or equal to the operating voltage of the load to the power controller, the step-down regulator steps the received input voltage down to a voltage equal to the operating voltage of the load and outputs the stepped-down voltage to the power controller, and the power controller outputs the input voltage it receives to the corresponding load according to a load control signal from the controller. The present invention can receive several input voltages at the same time and provide operating voltages for a plurality of loads at the same time, and has good flexibility and high reliability.

32 Claims, 16 Drawing Sheets

ADAPTIVE ELECTROTHERMAL SYSTEM AND ELECTROTHERMAL APPAREL

BACKGROUND OF THE INVENTION

1. Technical Field

The present invention relates to the field of electrical heating products, and particularly, to an adaptive electrothermal system and an electrothermal apparel.

2. Description of Related Art

Owing to the increasingly enhanced healthcare awareness of the people, electrothermal apparels become increasingly popular. The electrothermal apparels include but are not limited to heating overcoats, heating T-shirts, heating shirts, heating sweaters, heating vests, heating pants, heating underwear, heating caps, heating scarfs, heating gloves, heating socks, heating knee guards, heating elbow guards, heating shoulder guards, heating neck guards, heating wrist guards, heating waist supports, heating protection pads, heating sheaths, heating covers and so on.

As the living standard of the people improves, other electrothermal products than the electrothermal apparels have also found wide application in the daily life, including but not limited to articles for pet use, articles for baby use, and articles for outdoor use. The articles for pet use include but are not limited to heating dog beds, heating pads, heating pet apparels and heating pet food pots and so on; the articles for baby use include but are not limited to baby carriages, baby carriers, baby wraps, milk warming bags and so on; and the articles for outdoor use include but are not limited to heating sleeping bags, heating handbags, heating food bags, heating beverage thermal insulation bags, heating bread baskets and so on.

Currently for the electrothermal products listed above, a single voltage is used as the input voltage, so loss or damage of batteries thereof would make it impossible to continue use of the electrothermal apparels or electrothermal products. Accordingly, these products have poor adaptability.

BRIEF SUMMARY OF THE INVENTION

In view of the aforesaid problem, the present invention provides an adaptive electrothermal system and an electrothermal apparel, which are adaptive to various different voltage inputs and have good flexibility and high reliability.

The present invention provides an adaptive electrothermal system, which comprises a controller, a step-down regulator, a power controller and a load, wherein an input of the controller is configured to receive an input voltage, a first output of the controller is configured to output an input voltage higher than an operating voltage of the load to the step-down regulator, a second output of the controller is configured to output an input voltage lower than or equal to the operating voltage of the load to the power controller, the step-down regulator steps the received input voltage down to a voltage equal to the operating voltage of the load and outputs the stepped-down voltage to the power controller, and the power controller outputs the input voltage it receives to the corresponding load according to a load control signal from the controller.

Furthermore, the input of the controller is connected with a USB socket.

Furthermore, the adaptive electrothermal system further comprises at least one power source which has an output connected with the input of the controller.

Furthermore, the operating voltage of the load ranges between 3.2V~48V.

Furthermore, a voltage of the power source ranges between 3.2V~48V.

Furthermore, the power source comprises a lithium ion battery or lithium polymer battery having a voltage ranging between 3.2V~3.85V, a mobile power source having a voltage of 5V, a lithium ion battery or a lithium polymer battery having a voltage ranging between 6.4V~7.7V, an automobile battery having a voltage of 12V and/or a lithium ion battery or lithium polymer battery having a voltage ranging between 36V~48V.

Furthermore, the adaptive electrothermal system further comprises at least one power source protection circuit in one-to-one correspondence to the at least one power source, and each of the at least one power source protection circuit is connected in series between the corresponding power source and the input of the controller.

Furthermore, the adaptive electrothermal system further comprises a plurality of solar elements, and an output of each of the solar elements is connected with the input of the controller or with the input of the power source.

Furthermore, the adaptive electrothermal system further comprises a microprocessor, a plurality of heating zones and at least one heating module, the heating zones are each provided with a connector connected with the output of the step-down regulator of the adaptive electrothermal system, the heating module matches with the heating zones, an input of the heating module is adapted to the connectors of the heating zones, and an output of the microprocessor transmits a heating zone temperature control signal to a control terminal of the connector.

Furthermore, the microprocessor is sealed by silica gel.

Furthermore, the heating module comprises a thermal viscous fabric layer and a heat diffusion layer attached together and heating wires, heating paste or heating track sandwiched between the thermal viscous fabric layer and the heat diffusion layer.

Furthermore, the heating module further comprises a heat insulation layer attached to the bottom of the heat diffusion layer.

Furthermore, the heating module further comprises an elastic layer, and a bottom of the heat insulation layer is adhered on the elastic layer.

Furthermore, the microprocessor receives the heating zone temperature control signal transmitted by a mobile terminal via a wireless and/or Bluetooth module.

Furthermore, the mobile terminal performs a filtering search for an electrothermal system and connects to the electrothermal system found to generate a corresponding heating zone temperature control signal.

Furthermore, the microprocessor receives an environment temperature sensed by a temperature sensor to generate a heating zone temperature control signal.

Furthermore, the heating zone temperature control signal is a switching pulse signal in which a rising edge signal is transmitted until the corresponding heating module reaches a preset temperature, and then a falling edge signal is transmitted.

Furthermore, the heating zone temperature control signal comprises a temperature value which is targeted to reach and a desired time period of heating, the temperature value is represented in the form of Celsius or Fahrenheit temperature values.

Furthermore, the adaptive electrothermal system further comprises a display panel, and the display panel has an input thereof connected with an output of the microprocessor so as to display temperatures of the heating zones.

Furthermore, the display panel is sealed by silica gel.

Furthermore, the adaptive electrothermal system further comprises a button, and the button has an output thereof connected with the input of the microprocessor to input desired temperature values targeted to reach by the heating zones respectively.

Furthermore, arrows indicating a temperature increase or decrease, a temperature range and/or a temperature value are labeled on the button.

Furthermore, the button is sealed by silica gel.

Furthermore, the adaptive electrothermal system further comprises a memory, which has an input thereof connected with the output of the microprocessor to store the turn-on/off time, a temperature of the electrothermal system, time corresponding to the operation temperature and a type of the electrothermal system.

Furthermore, the light display on the button can be disabled or turned off by double-clicking on the button or received the index signal by the mobile terminal.

The present invention further provides an electrothermal apparel, which comprises a body of the apparel and the adaptive electrothermal system of any of claims 1 to 9, wherein the electrothermal system is filled in the body of the apparel.

Furthermore, the body of the apparel comprises a microprocessor, a plurality of heating zones and at least one heating module, the heating zones are each provided with a connector connected with the output of the step-down regulator of the adaptive electrothermal system, the heating module matches with the heating zones, an input of the heating module is adapted to the connectors of the heating zones, and an output of the microprocessor transmits a heating zone temperature control signal to a control terminal of the connector.

Furthermore, the microprocessor is sealed by silica gel.

Furthermore, the heating module comprises a thermal viscous fabric layer and a heat diffusion layer attached together and heating wires, heating paste or heating track sandwiched between the thermal viscous fabric layer and the heat diffusion layer.

Furthermore, the heating module further comprises a heat insulation layer attached to the bottom of the heat diffusion layer.

Furthermore, the heating module further comprises an elastic layer, and a bottom of the heat insulation layer is adhered on the elastic layer.

Furthermore, the microprocessor receives the heating zone temperature control signal transmitted by a mobile terminal via a wireless and/or Bluetooth module.

Furthermore, the mobile terminal performs a filtering search for an electrothermal apparel and connects to the electrothermal apparel found to generate a corresponding heating zone temperature control signal.

Furthermore, the microprocessor receives an environment temperature sensed by a temperature sensor to generate a heating zone temperature control signal.

Furthermore, the heating zone temperature control signal is a switching pulse signal in which a rising edge signal is transmitted until the corresponding heating module reaches a preset temperature, and then a falling edge signal is transmitted.

Furthermore, the heating zones include a collar, a sleeve mid-section, a sleeve elbow, a shoulder portion, a chest portion, a belly portion, a knee portion, a thigh portion, a buttock portion, a sleeve cuff portion, an upper back portion, a lower back portion and/or portions corresponding to other human body portions.

Furthermore, the heating zone temperature control signal comprises a temperature value which is targeted to reach and a desired time period of heating, the temperature value is represented in the form of Celsius or Fahrenheit temperature values.

Furthermore, the electrothermal apparel further comprises a display panel embedded into an outer surface of the body of the products or apparel, and the display panel has an input thereof connected with an output of the microprocessor so as to display temperatures of the heating zones.

Furthermore, the display panel is sealed by silica gel.

Furthermore, the electrothermal apparel further comprises a button embedded into the outer surface of the body of the apparel, and the button has an output thereof connected with the input of the microprocessor to input desired temperature values targeted to reach by the heating zones respectively.

Furthermore, the electrothermal apparel further comprises arrows indicating a temperature increase or decrease, a temperature range and/or a temperature value are labeled on the button.

Furthermore, the electrothermal apparel further comprises the button is sealed by silica gel.

Furthermore, the electrothermal apparel further comprises a memory, which has an input thereof connected with the output of the microprocessor to store the turn-on/off time, a temperature of the electrothermal apparel, time corresponding to the operation temperature and a type of the electrothermal apparel.

Furthermore, the light display on the button can be disabled or turned off by double-clicking on the button or received the index signal by the mobile terminal.

The present invention has the following benefits:

The current electrothermal products mainly use a single voltage as the input voltage, so loss or damage of batteries thereof would make it impossible to continue use of the electrothermal products, and this makes the adaptability of these products poor. In order to overcome this problem, the present invention provides a technical solution which is adaptive to various voltages, capable of adjusting the various input voltages into the operating voltage of a load via a step-down regulator and a power controller, and capable of receiving several input voltages at the same time and providing operating voltages for a plurality of loads at the same time, and has good flexibility and high reliability.

What described above is only a summary of the technical solutions of the present invention. In order for the technical means of the present invention to be better understood and to be implemented according to the content of the specification, and for the aforesaid and other objectives, features and advantages of the present invention to be more apparent and more readily understood, the specific implementations of the present invention will be described hereinbelow.

BRIEF DESCRIPTION OF THE SEVERAL VIEWS OF THE DRAWINGS

Various other advantages and benefits of the present invention will become more apparent to those of ordinary skill in the art upon reading the detailed description of preferred embodiments hereinbelow. The drawings are only used to present the preferred embodiments and should not be construed to limit the present invention. Like reference numerals refer to like components throughout the drawings, in which.

DETAILED DESCRIPTION OF THE INVENTION

Figure 1:
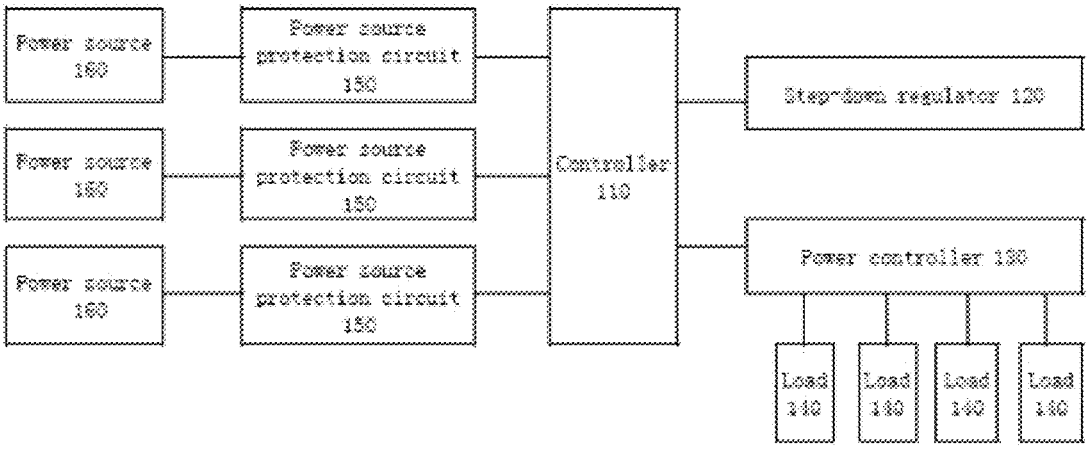
FIG. 1 is a schematic structural view of an adaptive electrothermal system in a first embodiment of the present invention.

Hereinafter, exemplary embodiments of the present disclosure will be described in greater detail with reference to the drawings. Although the exemplary embodiments of the present disclosure are shown in the drawings, it should be understood that, the present disclosure can be embodied in various forms and should not be limited to the embodiments described herein. Instead, these embodiments are provided to provide a more thorough understanding of the present disclosure and to convey the full scope of the present disclosure to those skilled in the art.

Hereinbelow, the present invention will be further detailed with reference to the drawings and the embodiments thereof.

Referring to FIG. 1, there is shown an adaptive electrothermal system according to a first embodiment of the present invention. The adaptive electrothermal system comprises a controller 110, a step-down regulator 120, a power controller 130 and a load 140. An input of the controller is configured to receive an input voltage, a first output of the controller is configured to output an input voltage higher than an operating voltage of the load to the step-down regulator, a second output of the controller is configured to output an input voltage lower than or equal to the operating voltage of the load to the power controller, the step-down regulator steps the received input voltage down to a voltage equal to the operating voltage of the load and outputs the stepped-down voltage to the power controller, and the power controller outputs the input voltage it receives to the corresponding load according to a load control signal from the controller.

The step-down regulator regulates different input voltages into a voltage equal to the operating voltage of the load. When the input voltage is lower than or equal to the operating voltage of the load, the input voltage will bypass the step-down regulator so as to avoid a voltage drop which would affect the heating effect.

Furthermore, the input of the controller is connected with a USB socket.

Furthermore, the adaptive electrothermal system further comprises at least one power source 160 which has an output connected with the input of the controller. At least one power plug may be provided corresponding to the number of the power sources.

Furthermore, a voltage of the load ranges between 3.2V~48V.

Furthermore, a voltage of the power source ranges between 3.2V~48V.

Furthermore, the power source comprises a lithium ion battery or lithium polymer battery having a voltage ranging between 3.2V~3.85V, a mobile power source having a voltage of 5V, a lithium ion battery or a lithium polymer battery having a voltage ranging between 6.4V~7.7V, an automobile battery having a voltage of 12V and/or a lithium ion battery or lithium polymer battery having a voltage ranging between 36V~48V.

The technical solution of this embodiment can be automatically adapted to input voltages ranging between 3.2V~48V so that the adaptability of the product is greatly enhanced. A user can not only use the external mobile power source having a voltage of 5V that is currently most common in the market, but also use the automobile battery having a voltage of 12V as the power source. In addition, this system can also use an electrical bicycle battery having a voltage ranging between 36V~48V as the power source.

The batteries may include but are not limited to the lithium ion battery and the lithium polymer battery. The lithium ion battery includes but is not limited to lithium manganese oxide spinel, lithium nickel cobalt oxide, lithium cobalt oxide and etc. The lithium polymer battery includes but is not limited to lithium nickel cobalt manganese oxide, lithium nickel cobalt aluminum oxide and etc. The automobile battery may include but is not limited to a lead-acid battery, lithium iron phosphate, lithium manganate oxide spinel and etc.

What is preferred is a USB battery having a voltage of 3.7V or 7.4V that has a small size, a light weight and good portability, or a mobile power source having a voltage of 5V that is more common. Therefore, the USB battery having a voltage of 3.7V or 7.4V and the mobile power source having a voltage of 5V can be directly connected with the USB socket, while power sources having a voltage ranging between 12V~48V are connected with the USB socket via adapting lines.

Furthermore, the adaptive electrothermal system further comprises at least one power source protection circuit 150 in one-to-one correspondence to the at least one power source, and each of the at least one power source protection circuit is connected in series between the corresponding power source and the input of the controller.

Furthermore, each of the at least one power source protection circuit is, but not limited to, a diode, which has a cathode thereof connected with an output of the power source and an anode thereof connected with the input of the controller.

Each of the at least one power source protection circuit can prevent one of the at least one power source (battery) from being damaged due to the reverse charging.

Furthermore, the adaptive electrothermal system further comprises a plurality of solar elements, and an output of each of the solar elements is connected with the input of the controller or with the input of the power source.

The solar elements can allow the electrothermal system to be used continuously without a battery, and can charge the battery with the solar energy when there is a battery, thereby extending the battery endurance of the product especially when the user spends a long time in outdoor activities.

The solar elements may include but are not limited to a monocrystalline silicon (c-Si) or polycrystalline silicon (mc-Si) solar cell, an amorphous silicon (a-Si) solar cell, a cadmium telluride (CdTe) solar cell, a copper indium gallium selenide (CIGS) solar cell, a Copper zinc tin sulfide (CZTS) solar cell, a dye-sensitized solar cell (DSSC), an organic photovoltaic (OPV) solar cell and a perovskite (PVSK) solar cell. The solar elements are made on a flexible substrate (e.g., a polyethylene terephthalate (PET) substrate or a stainless steel sheet), and are sealed by resin to be isolated from the environmental influences. For example, a solar element having a size of 300 mm×400 mm has an output power of about 6 W under the standard AM1.5 daylight illumination condition.

The present invention also provides a kind of electrothermal product (system) according to the second embodiment, in which it takes electrothermal apparel as an example for explanation, and the principle of other electrothermal products is same as that of electrothermal apparel. An electrothermal apparel, which comprises a body of the apparel and the adaptive electrothermal system as described above, with the electrothermal system being filled in the body of the apparel.

In this embodiment, the body of the apparel includes a heating coat and a pair of heating trousers. Optionally, the power source may be designed to be put at the lower left front side and the lower right front side of the heating coat to balance the weight, and the power source may have a voltage ranging between 3.2V~48V, which imparts the electrothermal apparel with better adaptability. The mobile power source having a voltage of 5V is widely used and is easy to use; and the USB battery having a voltage of 3.7V/7.4V has a small size and a light weight. The 5V mobile power source and the 3.7V and 7.4V batteries may be directly connected with the USB socket, while power sources having a voltage ranging between 12V~48V are connected with the USB socket via adapting lines.

The current electrothermal apparels or electrothermal products in the market mostly use a single battery, which has insufficient battery endurance and causes a weight imbalance for some apparels or products and obvious uncomfortableness in wearing. The technical solution of this embodiment can use two or more batteries at the same time, which can achieve weight balance of the apparels or products more flexibly, properly increase the charge capacity of the batteries, and multiply the battery endurance of the electrothermal apparels or the electrothermal products.

Because there may be a plurality of input voltages at the same time, at least one power source protection circuit can be provided to prevent each of the power sources (batteries) from being damaged due to the reverse charging.

Figure 2:
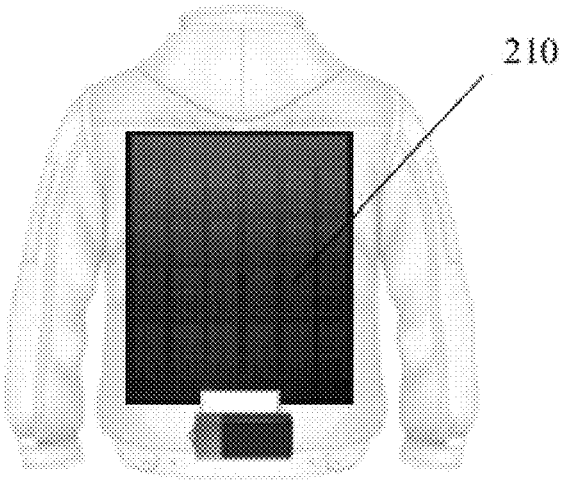
FIG. 2 is a schematic structural view of an electrothermal apparel having a solar cell assembly in a second embodiment of the present invention.
Figure 3:
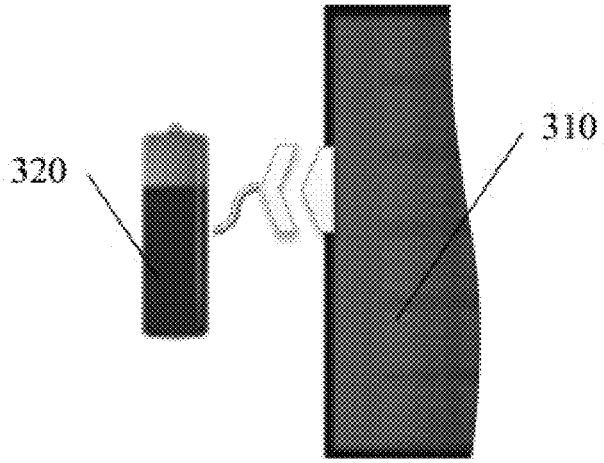
FIG. 3 is a schematic view illustrating a charging process of the solar cell assembly in the second embodiment of the present invention.

Referring to FIG. 2, a solar cell assembly 210 is provided so that the product can still be used when no battery is provided. Referring to FIG. 3, when there is a battery, a solar cell assembly 310 can charge the battery 320 with the solar energy to extend the battery endurance especially when the user spends a long time in outdoor activities. In this embodiment, in order to enhance the functionality of the apparel, agraffes are bonded on the solar elements so that the solar elements can be quickly connected to or detached from the body of the apparel. In order to further improve the simplicity of connection in power supplying, a wireless charging system is integrated with the solar elements to charge the batteries in the apparel wirelessly, and more than one wireless charging receiver module is integrated into the body of the apparel correspondingly. The more than one wireless charging receiver module can not only receive the electricity transmitted by the solar cell assembly but also charge the built-in batteries by the wireless charging power source wirelessly when the apparel is stationary. For example, a hanger having a wireless charging transmission device disposed therein can charge the apparel hanged thereon. A same battery can be charged by different solar elements at the same time.

Furthermore, the body of the apparel or an adaptive electrothermal system comprises a microprocessor, a plurality of heating zones and at least one heating module. The heating zones are each provided with a connector connected with the output of the step-down regulator of the adaptive electrothermal system, the heating module matches with the heating zones, an input of the heating module is adapted to the connectors of the heating zones, and an output of the microprocessor transmits a heating zone temperature control signal to a control terminal of the connector. Furthermore, the microprocessor is sealed by silica gel. The electrothermal apparel in this embodiment operates on low-voltage DC power, and the electronic elements therein are encapsulated so as to be water-proof during washing. It has been found through a test that, when the connector is wetted by water, the resistance value of water within a distance of no more than 0.5 cm is larger than 5 Mohm, which is obtained through measurement with a multimeter FLUKE 17B at the room temperature, and such problems as short-circuiting and poor contact will not happen to the connector connected with the low-voltage heating module so that the apparel can be washed repeatedly.

Figure 4:
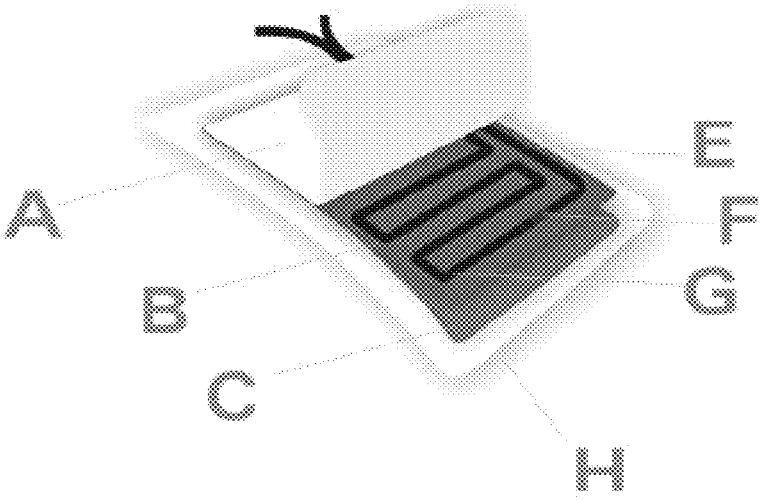
FIG. 4 is a schematic structural view of a heating module in the second embodiment of the present invention.

Furthermore, referring to FIG. 4, the heating module comprises a thermal viscous fabric layer A and a heat diffusion layer B attached together and heating wires, heating paste or heating track G sandwiched between the thermal viscous fabric layer and the heat diffusion layer, and the heating wires G are connected with a connector F via connection wires E. Furthermore, the heating module further comprises a heat insulation layer C attached to the bottom of the heat diffusion layer. Furthermore, the heating module further comprises an elastic layer H, and a bottom of the heat insulation layer is adhered on the elastic layer. The area of the elastic layer that extends beyond the heat insulation layer can be stretched outward. When the heating module is stretched by external forces, the elastic layer can be elongated so that the heating zones of the electrothermal apparel can be elastically deformed to make it easier to wear and use.

Figure 5:
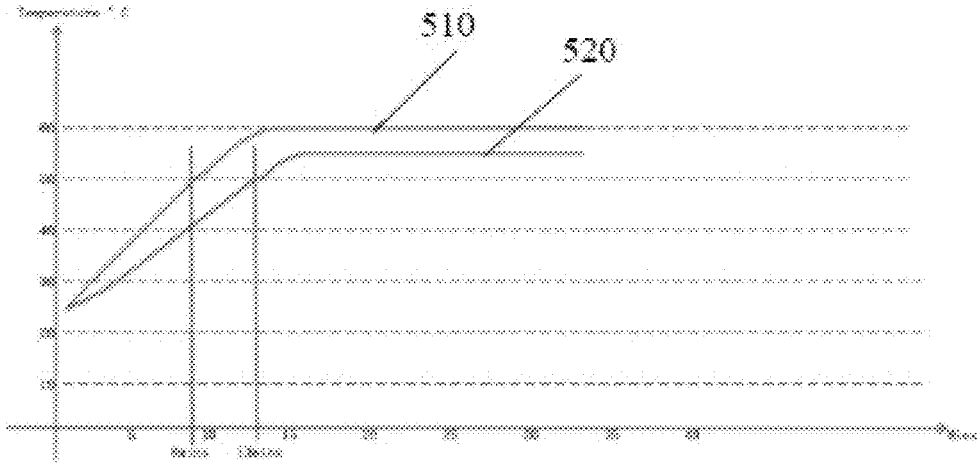
FIG. 5 is a schematic view illustrating temperature curves of the heating module in the second embodiment of the present invention.
Figure 6A:
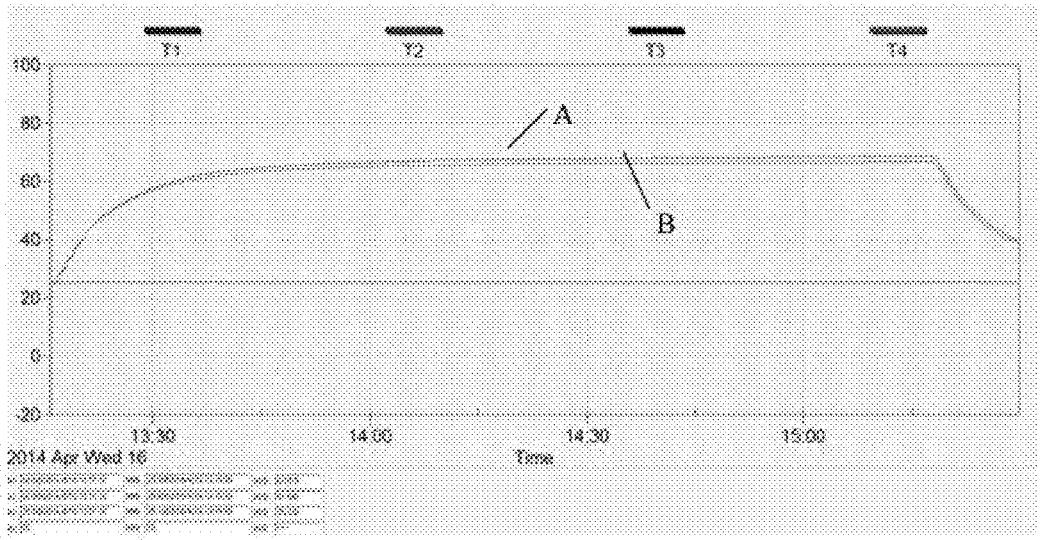
FIG. 6*a* is a schematic view illustrating a first kind of temperature curve of the electrothermal apparel in the second embodiment of the present invention.
Figure 6B:
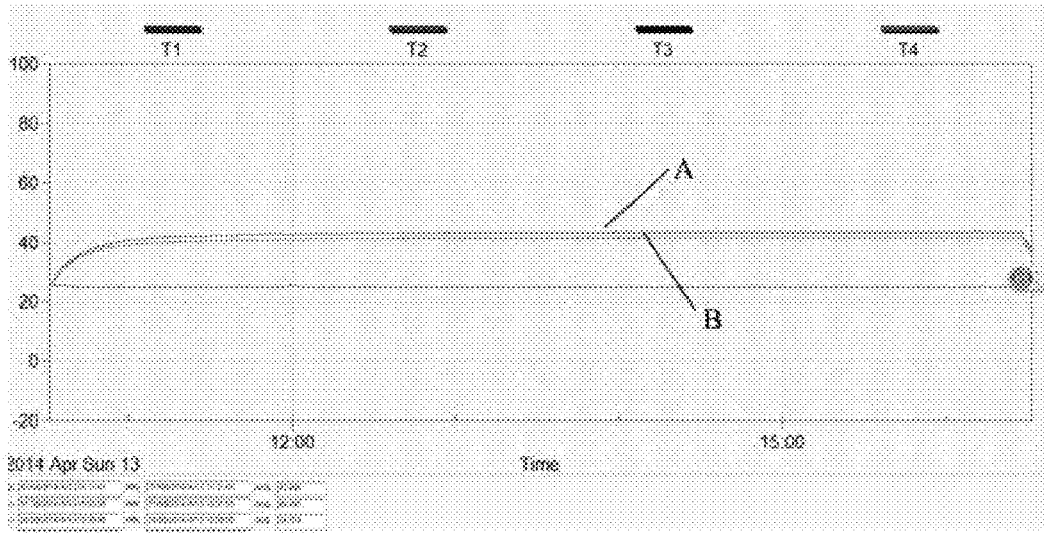
FIG. 6*b* is a schematic view illustrating a second kind of temperature curve of the electrothermal apparel in the second embodiment of the present invention.
Figure 6C:
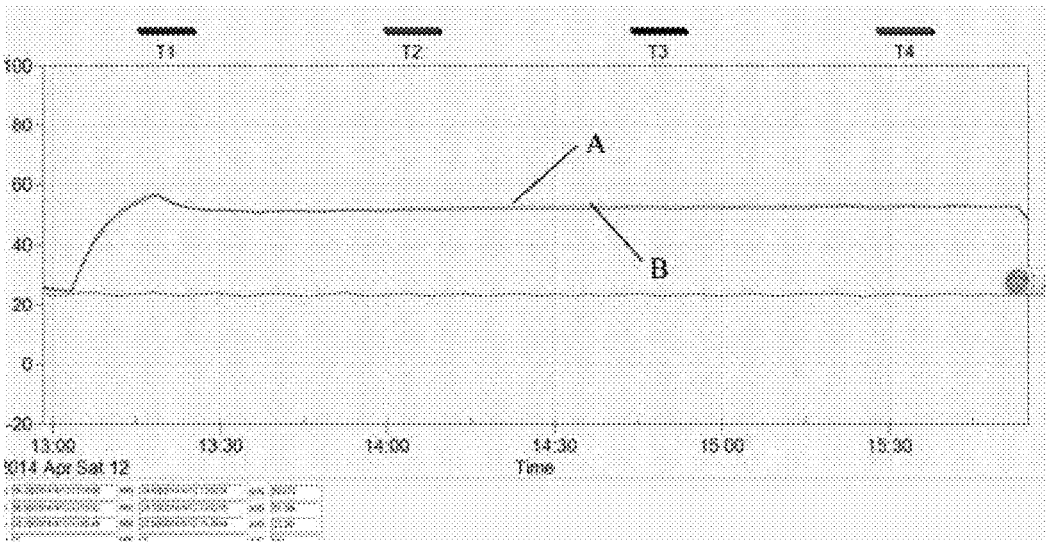
FIG. 6*c* is a schematic view illustrating a third kind of temperature curve of the electrothermal apparel in the second embodiment of the present invention.

The heating module of this embodiment is formed by winding the heating wires onto a sheet of heat dissipating material (referred as heat diffusion layer B), and a sheet of knit is covered on the back side of the heat dissipating material so that the heat can be emitted by the heat dissipating layer in a uniform manner and dissipated in a single direction. The heat dissipating layer B includes but is not limited to Dacron and heat reflective fabric, and the heat insulation layer C includes but is not limited to knit, heat insulation fabric, polar fleece, cotton and silicon gel sheet. Referring to FIG. 5, the temperature rising rate of a heating curve 510 of the heating module that comprises the thermal viscous fabric layer A and the heat diffusion layer B attached together and the heating wires G sandwiched therebetween (referred to as mode 1 hereinbelow) is higher by 30% than that of a heating curve 520 of the heating module that is formed by winding the heating wires around a piece of fabric (referred to as mode 2 hereinbelow). When the temperature of the electrothermal apparel is 60 Celsius degrees (as shown in FIG. 6*a*) and 40 Celsius degrees (as shown in FIG. 6*b*), and when the temperature of the electrothermal apparel is adjusted automatically (as shown in FIG. 6*c*), the temperature curves A of the mode 1 all have a higher heating rate than and are steadier than the temperature curves B of the mode 2.

Furthermore, the heating zones include a collar, a sleeve mid-section, a sleeve elbow, a shoulder portion, a chest portion, a belly portion, a knee portion, a thigh portion, a buttock portion, a sleeve cuff portion, an upper back portion, a lower back portion and/or portions corresponding to other human body portions.

Figure 7:
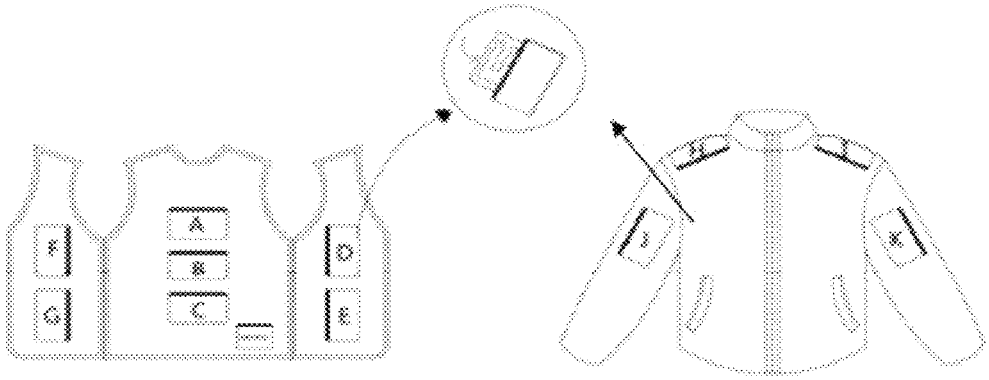
FIG. 7 is a schematic structural view of the electrothermal apparel in the second embodiment of the present invention.

Heating modules are disposed into various different default portions of the product depending on the thermal requirement of human body in a cold environment, and the controller can control the On/Off and the temperature adjustment of each of the heating modules separately. Referring to FIG. 7, the heating modules of the heating zones are detachable and removable, and the On/Off and the temperature adjustment of each of the heating zones can be controlled separately depending on the needs or preferences of each individual, thereby achieving real smartness.

Figure 8A:
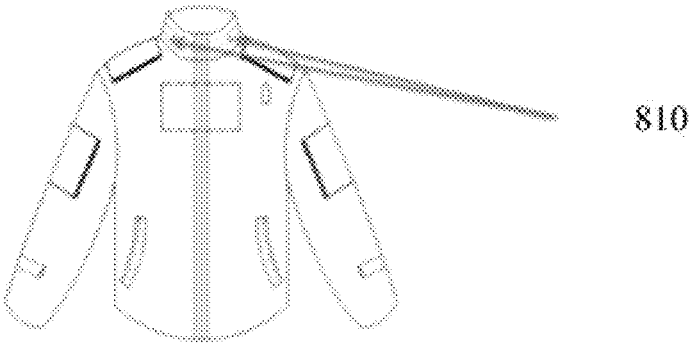
FIG. 8*a* is a schematic structural view of an electrothermal apparel whose collar is a heating zone in the second embodiment of the present invention.
Figure 8B:
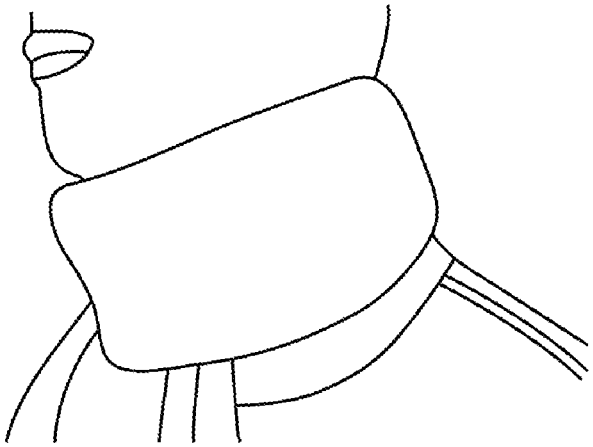
FIG. 8*b* is a schematic structural view of an electrothermal scarf in the second embodiment of the present invention.

Referring to FIG. 8*a*, a heating module 810 is assembled into a collar. Because the neck gets cold more easily than any other parts of the human body, people all have to wear a scarf or an overcoat having a hood to keep the neck warm in a cold environment; and if the neck stays warm, almost the whole human body will feel comfortable. Accordingly, referring to FIG. 8*b*, the heating module may also be embedded into a scarf. Carbon fiber heating wires, heating paste, or heating track can be directly woven into the scarf so that the user is not apt to feel the presence of any wire and the scarf can be folded casually and is easy to carry.

Figure 9:
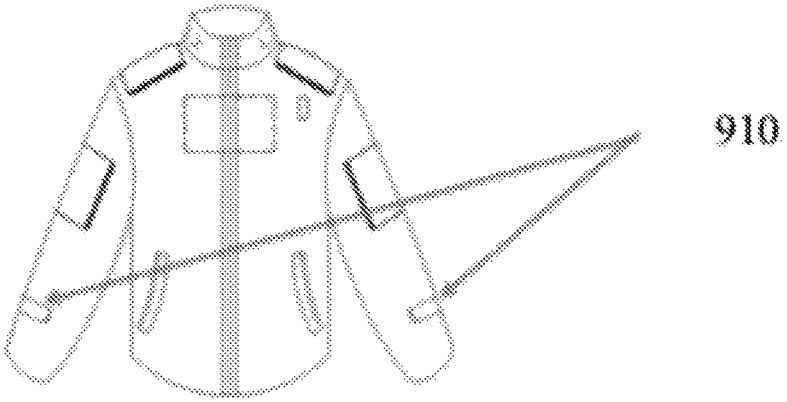
FIG. 9 is a schematic structural view of an electrothermal apparel whose sleeve cuff portions are heating zones in the second embodiment of the present invention.

Referring to FIG. 9, a heating module 910 is assembled into the sleeve cuff portion to replace the heating gloves. The user only needs to shrink his or her hands into the sleeve cuffs to keep warm when needed, thereby saving the user who works outdoors the inconvenience of putting on and taking off the gloves.

Figure 10:
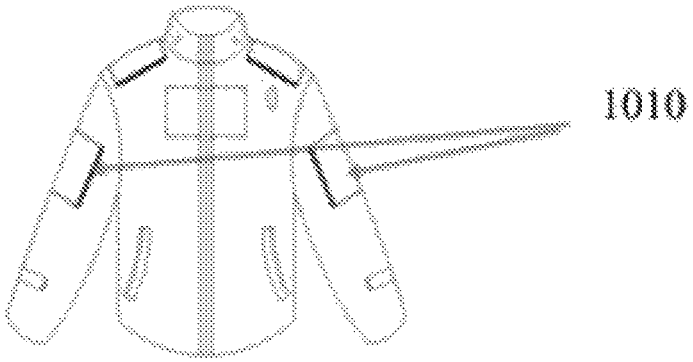
FIG. 10 is a schematic structural view of an electrothermal apparel whose sleeve elbow portions are heating zones in the second embodiment of the present invention.

Referring to FIG. 10, a heating module 1010 is assembled into the sleeve elbow portion. It has been found through a test that, the heat from the sleeve elbow portion can keep the whole arm warm. A very special function is that the heat from the sleeve elbow portion can enhance the blood circulation of the arm, which makes the hands more flexible in cold weather.

Figure 11:
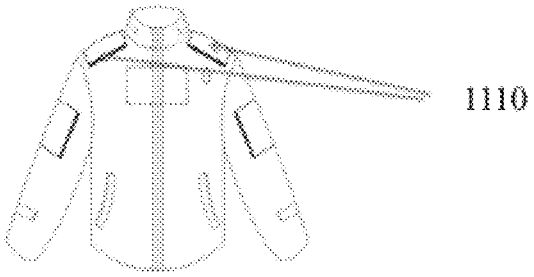
FIG. 11 is a schematic structural view of an electrothermal apparel whose shoulder portions are heating zones in the second embodiment of the present invention.

Referring to FIG. 11, a heating module 1110 is assembled into the shoulder portion. In addition to the warm-keeping function, the heat from the shoulder portion can relieve pressure and provide relaxation for the current city dwellers who works hard every day.

Figure 12:
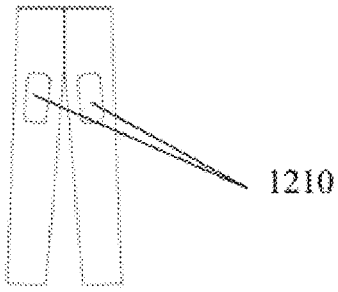
FIG. 12 is a schematic structural view of an electrothermal apparel whose thigh portions are heating zones in the second embodiment of the present invention.

Referring to FIG. 12, a heating module 1210 is assembled into the thigh portion to keep the feet warm in cold weather, and the warm feet can relax the muscles and keep the muscles flexible in moving.

Furthermore, the microprocessor receives the heating zone temperature control signal transmitted by a mobile terminal via a wireless and/or Bluetooth module.

Figure 13A:
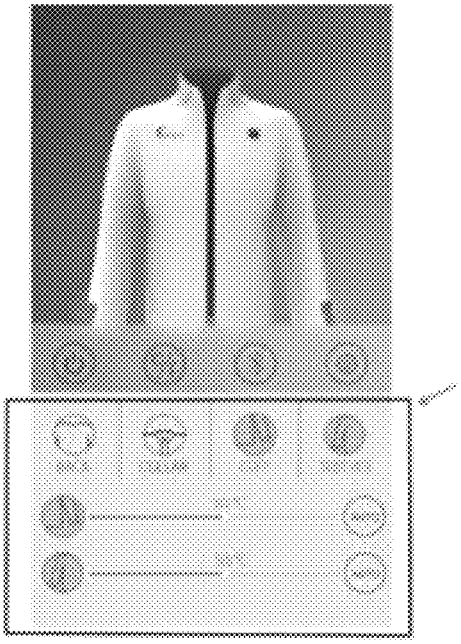
FIG. 13*a* is a first schematic view illustrating a control interface of a mobile terminal in the second embodiment of the present invention.
Figure 13B:
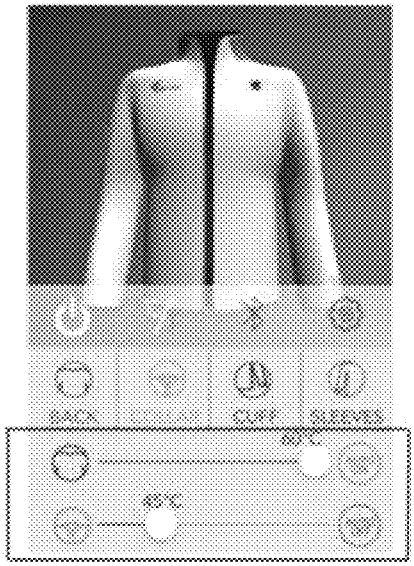
FIG. 13*b* is a second schematic view illustrating the control interface of the mobile terminal in the second embodiment of the present invention.

As can be known from the control interfaces on the mobile terminal shown in FIG. 13*a* and FIG. 13*b*, the temperature can be adjusted continuously to increase or decrease the temperature in units of ° C. or ° F.

Furthermore, the heating zone temperature control signal comprises a temperature value which is targeted to reach and a desired time period of heating, the temperature value is represented in the form of Celsius or Fahrenheit temperature values.

Furthermore, the electrothermal apparel further comprises a memory, which has an input thereof connected with the output of the microprocessor to store the turn-on/off time, a temperature of the electrothermal apparel, time corresponding to the operation temperature and a type of the electrothermal apparel. For the user who treats the injured parts by heat, the memory of the electrothermal system can record and transmit back related usage records to the user or to a therapist as the data of medical records.

Furthermore, the heating zone temperature control signal is a switching pulse signal in which a rising edge signal is transmitted until the corresponding heating module reaches a preset temperature, and then a falling edge signal is transmitted.

In practical implementations, the turn-on (i.e., a rising edge pulse) time is used to determine the temperature increase, and the turn-off time is used to balance the temperature. When the temperature reaches a desired temperature during the turn-on time, the heating is turned off (i.e., a falling edge pulse is transmitted), and because the temperature decreasing will be delayed after the temperature increasing, the delaying time is used as the frequency of switching to maintain the heating status.

The turn-on/off time may vary depending on the different requirements of different electrothermal products or electrothermal apparels. In this embodiment, for example, the switching pulse time is 5 s.

Figure 14A:
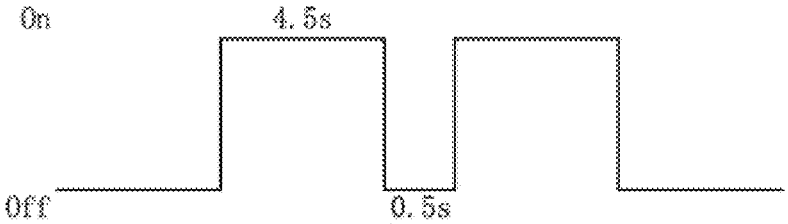
FIG. 14*a* is a schematic view illustrating a switching pulse when the temperature reached is 60 Celsius degrees in the second embodiment of the present invention.
Figure 14B:
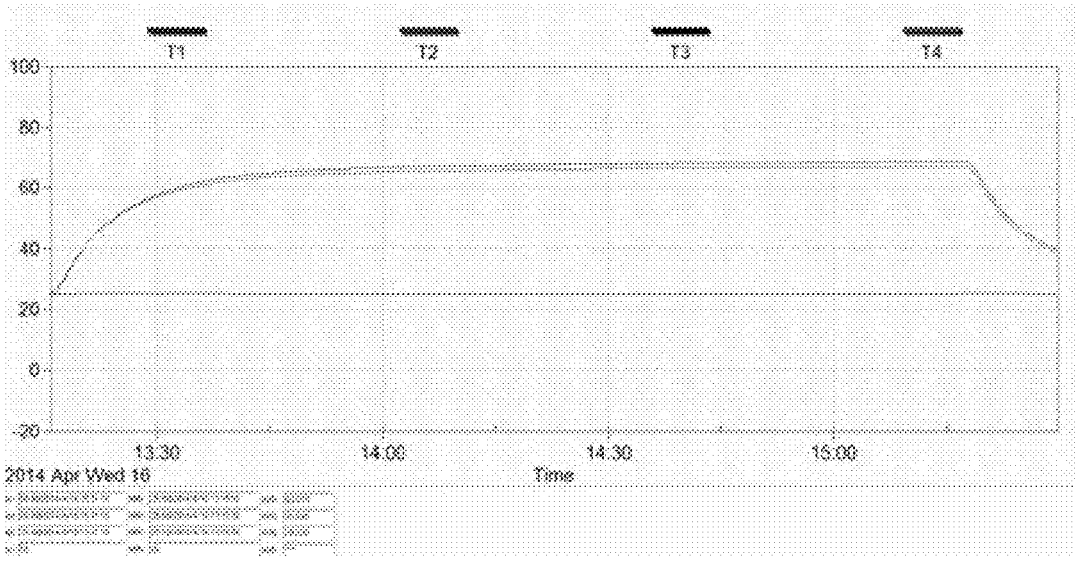
FIG. 14*b* is a schematic view illustrating a temperature curve when the temperature reached is 60 Celsius degrees in the second embodiment of the present invention.

Referring to FIG. 14*a* and FIG. 14*b*, turning on for 4.5 s and turning off for 0.5 s results in a temperature of 60 Celsius degrees.

Figure 15A:
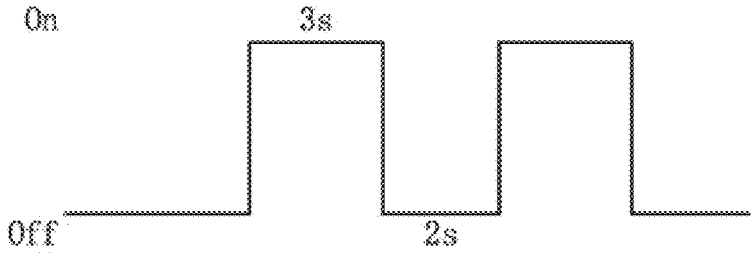
FIG. 15*a* is a schematic view illustrating a switching pulse when the temperature reached is 50 Celsius degrees in the second embodiment of the present invention.
Figure 15B:
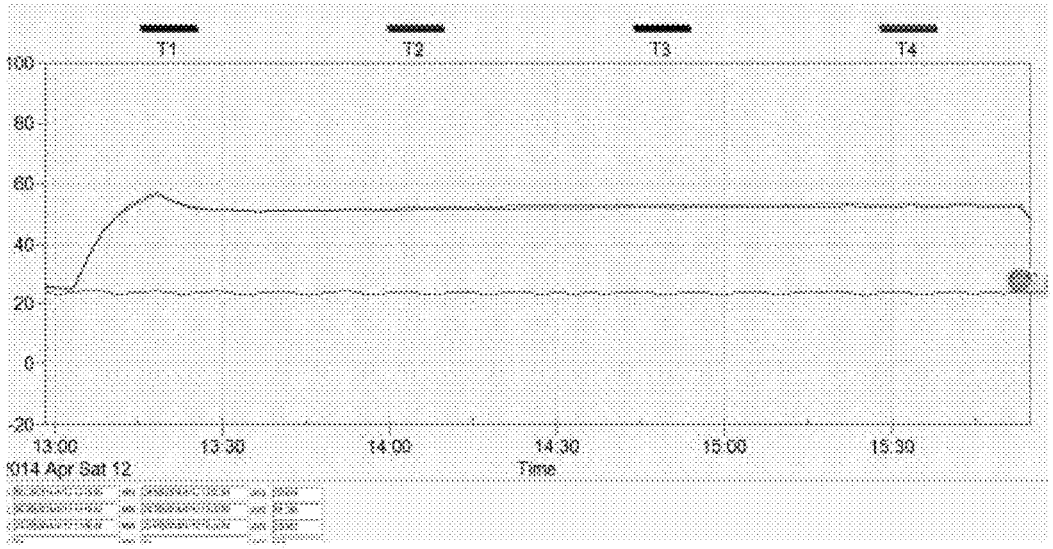
FIG. 15*b* is a schematic view illustrating a temperature curve when the temperature reached is 50 Celsius degrees in the second embodiment of the present invention.

Referring to FIG. 15*a* and FIG. 15*b*, turning on for 3 s and turning off for 2 s results in a temperature of 50 Celsius degrees.

Figure 16A:
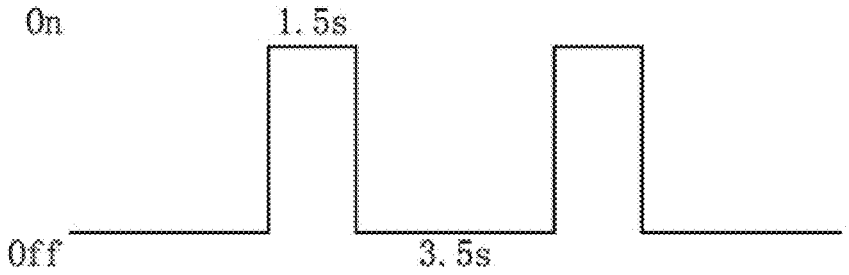
FIG. 16*a* is a schematic view illustrating a switching pulse when the temperature reached is 40 Celsius degrees in the second embodiment of the present invention.
Figure 16B:
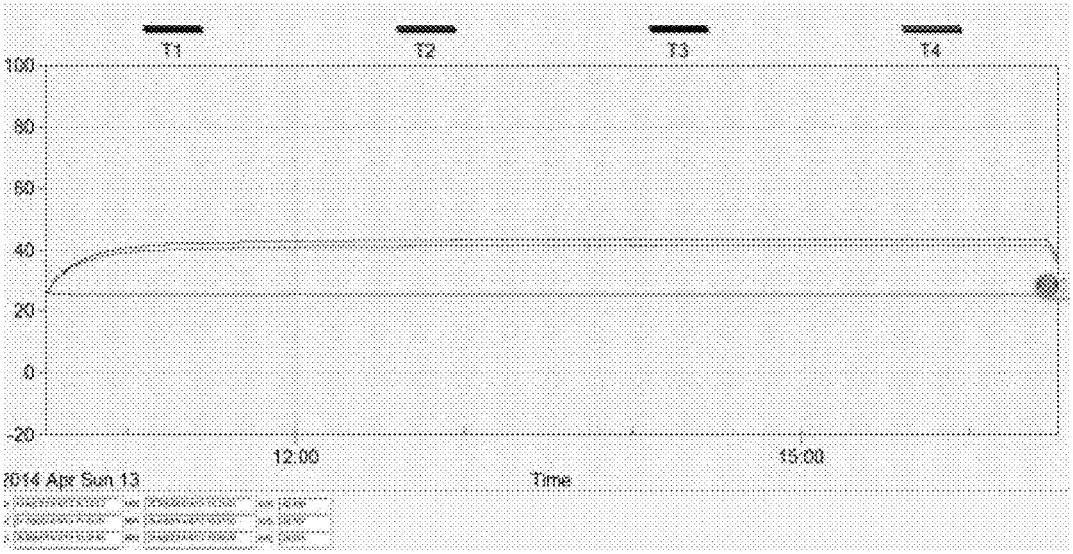
FIG. 16*b* is a schematic view illustrating a temperature curve when the temperature reached is 40 Celsius degrees in the second embodiment of the present invention.

Referring to FIG. 16*a* and FIG. 16*b*, turning on for 1.5 s and turning off for 3.5 s results in a temperature of 40 Celsius degrees.

Because of the resistance value error of the heating material, the temperature may also have an error of ±5 degrees.

Technically, the turn-on time is used to determine the temperature increase, and the turn-off time is used to balance the temperature. When the temperature reaches a desired temperature during the turn-on time, the temperature decreasing will be delayed after the temperature increasing, and the delaying time will be used as the frequency of switching to maintain a constant temperature.

Figure 17:
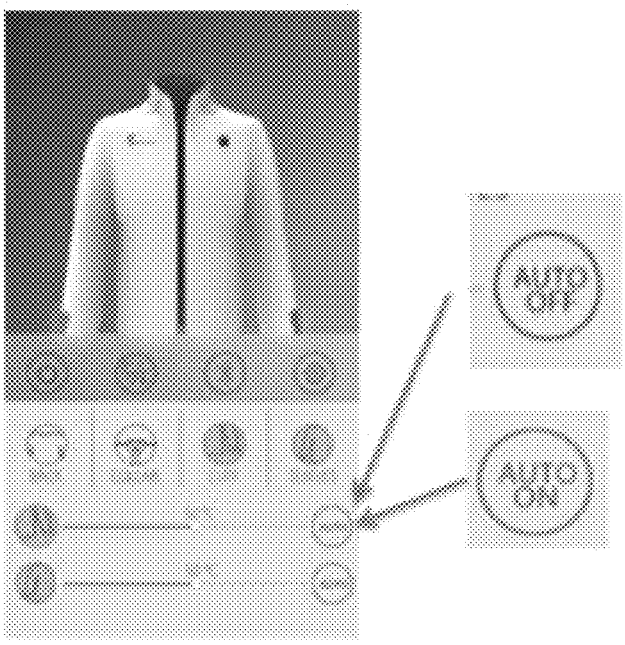
FIG. 17 is a schematic view illustrating a control interface for smart adjustment in the second embodiment of the present invention.

Refer to FIG. 17. Furthermore, the microprocessor receives an environment temperature sensed by a temperature sensor to generate a heating zone temperature control signal. In addition to adjusting the temperature according to the temperature selected by the user, smart adjustment modes may also be preset in the microprocessor.

The smart adjustment modes may include but are not limited to the following.

A first mode is: different turn-on default temperatures and operating default temperatures are set depending on different using conditions of different electrothermal products or electrothermal apparels. In this embodiment, an electrothermal apparel worn by people is taken as an example. In general, a comfortable temperature for the human body ranges between 20~60 Celsius degrees. However, when it is required to increase the body temperature in cold weather, the temperature needs to be increased quickly at the very beginning, and then be kept constant. Optionally, the turn-on default temperature is set to be 60 Celsius degrees, and the operating default temperature is set to be 50 Celsius degrees. During the first 15 minutes after the electrothermal apparel is turned on, the power output is 100% and the temperature reaches 60 Celsius degrees. 15 minutes later, the temperature is automatically adjusted to 50 Celsius degrees, and the electrothermal apparel enters a temperature-constant pulsing state so as to save energies.

TABLE 1

Table of correspondence relationship between environment temperatures and automatic adjusting temperatures

| Environment temperature | Automatic adjusting temperature |
|---|---|
| 5° C. to 10° C. | 45° C. |
| 0° C. to 5° C. | 50° C. |
| −1° C. to −10° C. | 60° C. |

TABLE 2

Table of correspondence relationship between environment temperatures and resistance parameters of the temperature sensor

| R/T-Curve:KDT-P09 | | | | | | | | | | | | | |
|---|---|---|---|---|---|---|---|---|---|---|---|---|---|
| R at (25° C.) | | 10 KΩ ± 1% | | | | | | B25/85 | | 3435 K ± 1% | | | |
| Temp (° C.) | AVG (Kohm) | Temp (° C.) | AVG (Kohm) | Temp (° C.) | AVG (Kohm) | Temp (° C.) | AVG (Kohm) | Temp (° C.) | AVG (Kohm) | Temp (° C.) | AVG (Kohm) | Temp (° C.) | AVG (Kohm) |
| −40 | 201.630 | −1 | 28.859 | 38 | 6.230 | 77 | 1.816 | 116 | 0.662 | 155 | 0.286 | 194 | 0.141 |
| −39 | 190.566 | 0 | 27.624 | 39 | 6.016 | 78 | 1.765 | 117 | 0.646 | 156 | 0.280 | 195 | 0.138 |
| −33 | 180.195 | 1 | 26.443 | 40 | 5.811 | 79 | 1.716 | 118 | 0.632 | 157 | 0.275 | 196 | 0.136 |
| −37 | 170.469 | 2 | 25.320 | 41 | 5.613 | 80 | 1.669 | 119 | 0.617 | 158 | 0.269 | 197 | 0.134 |
| −36 | 161.344 | 3 | 24.253 | 42 | 5.423 | 81 | 1.622 | 120 | 0.603 | 159 | 0.264 | 198 | 0.132 |
| −35 | 152.778 | 4 | 23.237 | 43 | 5.241 | 82 | 1.578 | 121 | 0.589 | 160 | 0.259 | 199 | 0.129 |
| −34 | 144.663 | 5 | 22.272 | 44 | 5.066 | 83 | 1.535 | 122 | 0.576 | 161 | 0.254 | 200 | 0.127 |
| −33 | 137.041 | 6 | 21.347 | 45 | 4.897 | 84 | 1.493 | 123 | 0.563 | 162 | 0.249 | | |
| −32 | 129.880 | 7 | 20.467 | 46 | 4.735 | 85 | 1.453 | 124 | 0.550 | 163 | 0.245 | | |
| −31 | 123.147 | 8 | 19.629 | 47 | 4.579 | 86 | 1.414 | 125 | 0.538 | 164 | 0.240 | | |
| −30 | 116.814 | 9 | 18.831 | 48 | 4.429 | 87 | 1.376 | 126 | 0.526 | 165 | 0.236 | | |
| −29 | 110.806 | 10 | 18.070 | 49 | 4.285 | 88 | 1.339 | 127 | 0.514 | 166 | 0.231 | | |
| −23 | 105.152 | 11 | 17.341 | 50 | 4.147 | 89 | 1.304 | 128 | 0.503 | 167 | 0.227 | | |
| −27 | 99.829 | 12 | 16.647 | 51 | 4.013 | 90 | 1.269 | 129 | 0.492 | 168 | 0.223 | | |
| −26 | 94.816 | 13 | 15.985 | 52 | 3.884 | 91 | 1.236 | 130 | 0.481 | 169 | 0.219 | | |

A second mode is: the temperature of the product is adjusted automatically according to the environment temperature. In this embodiment, an electrothermal apparel worn by people is taken as an example. An external temperature sensor that is installed on the surface of the electrothermal apparel can present different resistance parameters in response to different temperatures and then transmit back the different resistance parameters to the microprocessor. Then, the microprocessor automatically adjusts the pulse switching frequency according to the environment temperatures corresponding to the resistance parameters so as to adjust the temperature of the electrothermal apparel to reach a corresponding temperature. Referring to table 1 and table 2, adjusting temperatures corresponding to the environment temperatures are preset in the microprocessor. For example, if the environment temperature ranges between −5~0 degrees, then the temperature of the electrothermal apparel is adjusted to 55 degrees.

Furthermore, the mobile terminal performs a filtering search for an electrothermal apparel and connects to the electrothermal apparel found to generate a corresponding heating zone temperature control signal.

After being installed with an Apps control system, the mobile terminal can communicate with the electrothermal apparel via the Bluetooth or wireless module, and the same Apps control system can control a plurality of different electrothermal products.

Because the Apps control system is provided with a filtering function, only authorized products can be found via the Bluetooth or wireless module. The products may be authorized by brand owners or manufacturers.

Furthermore, the electrothermal apparel further comprises a display panel embedded into an outer surface of the body of the apparel, and the display panel has an input thereof connected with an output of the microprocessor so as to display temperatures of the heating zones. Furthermore, the display panel is sealed by silica gel.

Furthermore, the electrothermal apparel further comprises a button embedded into the outer surface of the body of the apparel, and the button has an output thereof connected with the input of the microprocessor to input desired temperature values targeted to reach by the heating zones respectively.

Furthermore, arrows indicating a temperature increase or decrease, a temperature range and/or a temperature value are labeled on the button. Furthermore, the button is sealed by silica gel. The electronic control buttons are made of a silicon gel material, the output wire on the PCBA is also made of a silicon gel materials, and the encapsulation still uses a silicon gel material so that the entire electrothermal apparel is formed into one piece after being sealed, thus achieving the purpose of being water-proof. Even if the connector of the heating body is wetted by water, problems such as short-circuiting and poor contact will not happen to the connector of the low-voltage heating body because the resistance value of water within a distance of no more than 0.5 cm is larger than 5 Mohm (which is obtained through measurement with a multimeter FLUKE 17B). Therefore, the electrothermal apparel can be washed repeatedly.

Figure 18:
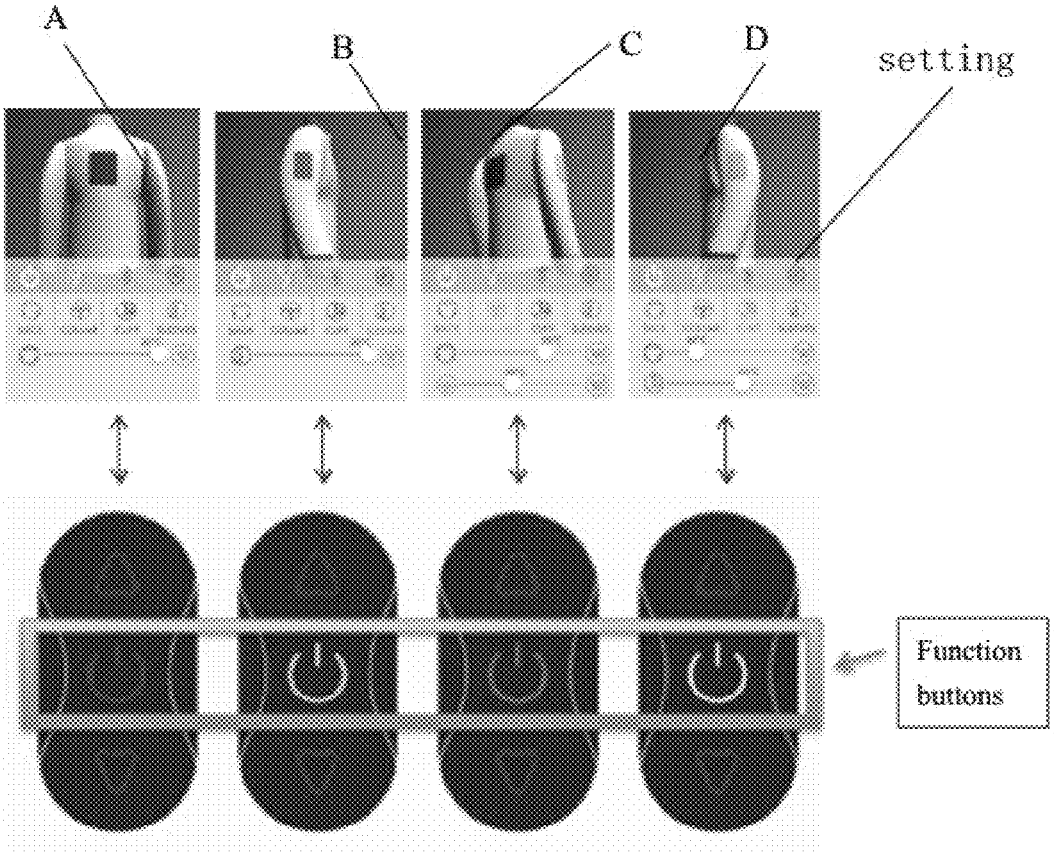
FIG. 18 is a schematic view illustrating how buttons and control interfaces display switching statuses of the electrothermal apparel in the second embodiment of the present invention.

Referring to FIG. 18, the operating interfaces displayed by the buttons and the mobile terminal (or the display panel embedded into the surface of the electrothermal apparel) can display the switching status of the electrothermal apparel instantly and synchronously via Bluetooth or wirelessly. Specifically, A displays the switching status of the back portion synchronously, B displays the switching status of the sleeve portions synchronously, C displays the switching statuses of the back portion and the collar portion synchronously, and D displays the switching status of the back portion and the sleeve portions synchronously.

Furthermore, double-clicking the function button can turn off the LED lamp without switching or changing the present heat setting. This function is to allow user to disable the light display when not desired. The light display can also be turned off from within the setting in the mobile terminals via Bluetooth or wirelessly.

Figure 19:
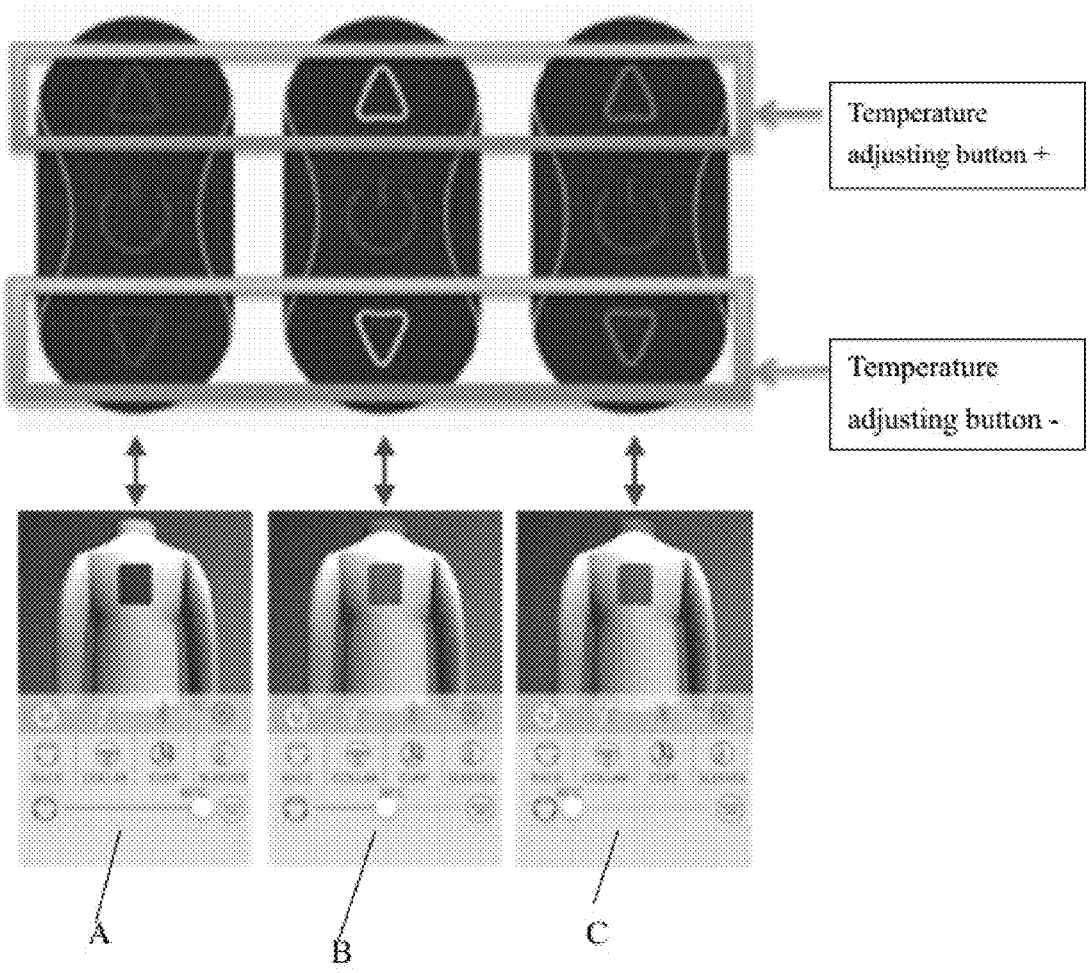
FIG. 19 is a schematic view illustrating how the buttons and the control interfaces display temperature statuses of the electrothermal apparel in the second embodiment of the present invention.

Referring to FIG. 19, the operating interfaces displayed by the buttons and the mobile terminal (or the display panel embedded into the surface of the electrothermal apparel) can display the temperature status of the electrothermal apparel instantly and synchronously via Bluetooth or wirelessly. Specifically, A synchronously displays that the temperature is set to be the highest temperature of 60 degrees, B synchronously displays that the temperature is set to be the medium temperature of 50 degrees, and C synchronously displays that the temperature is set to be the lowest temperature of 40 degrees.

Figure 20:
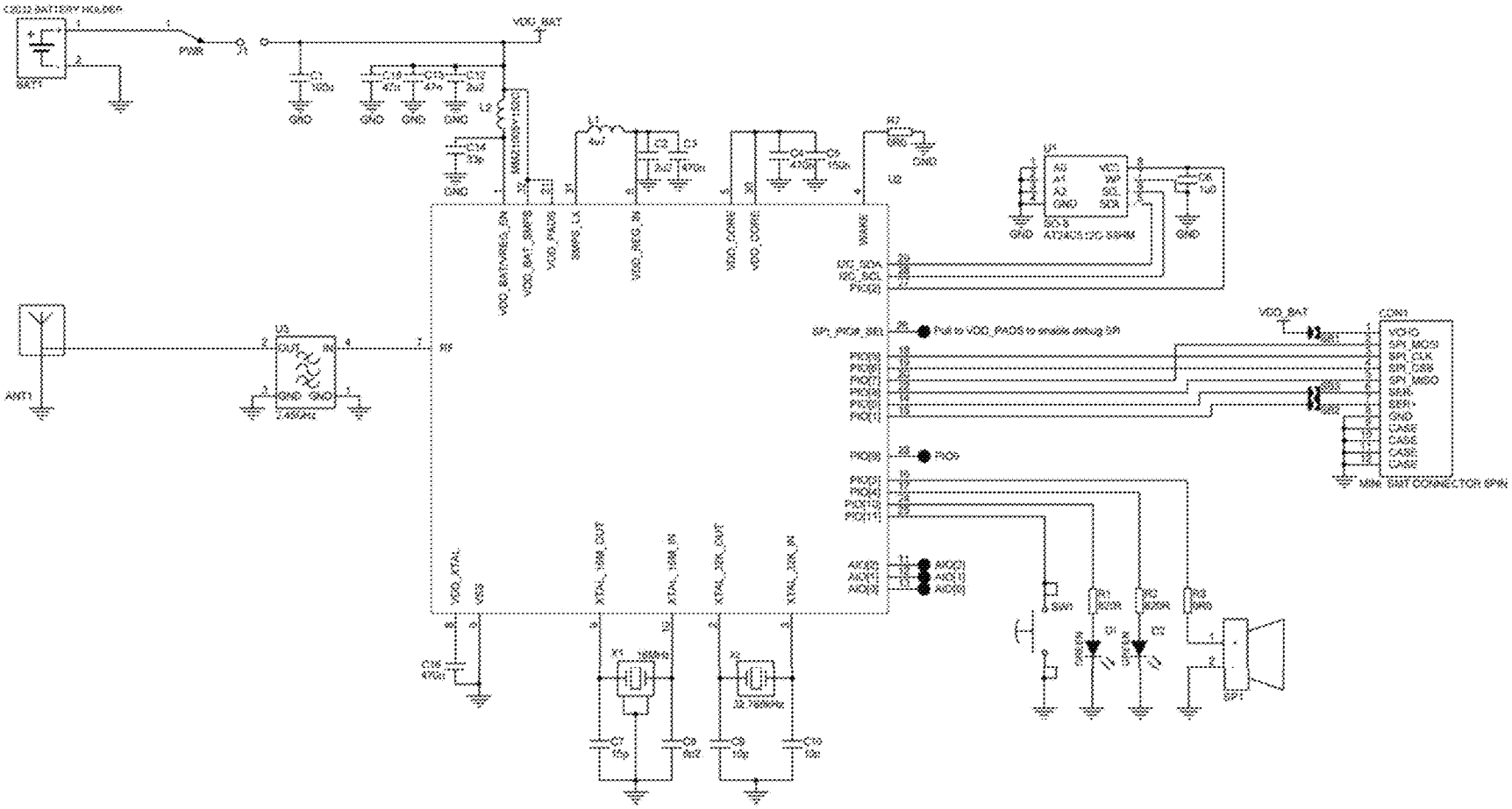
FIG. 20 is a schematic circuit diagram of a microprocessor in the second embodiment of the present invention.
Figure 21:
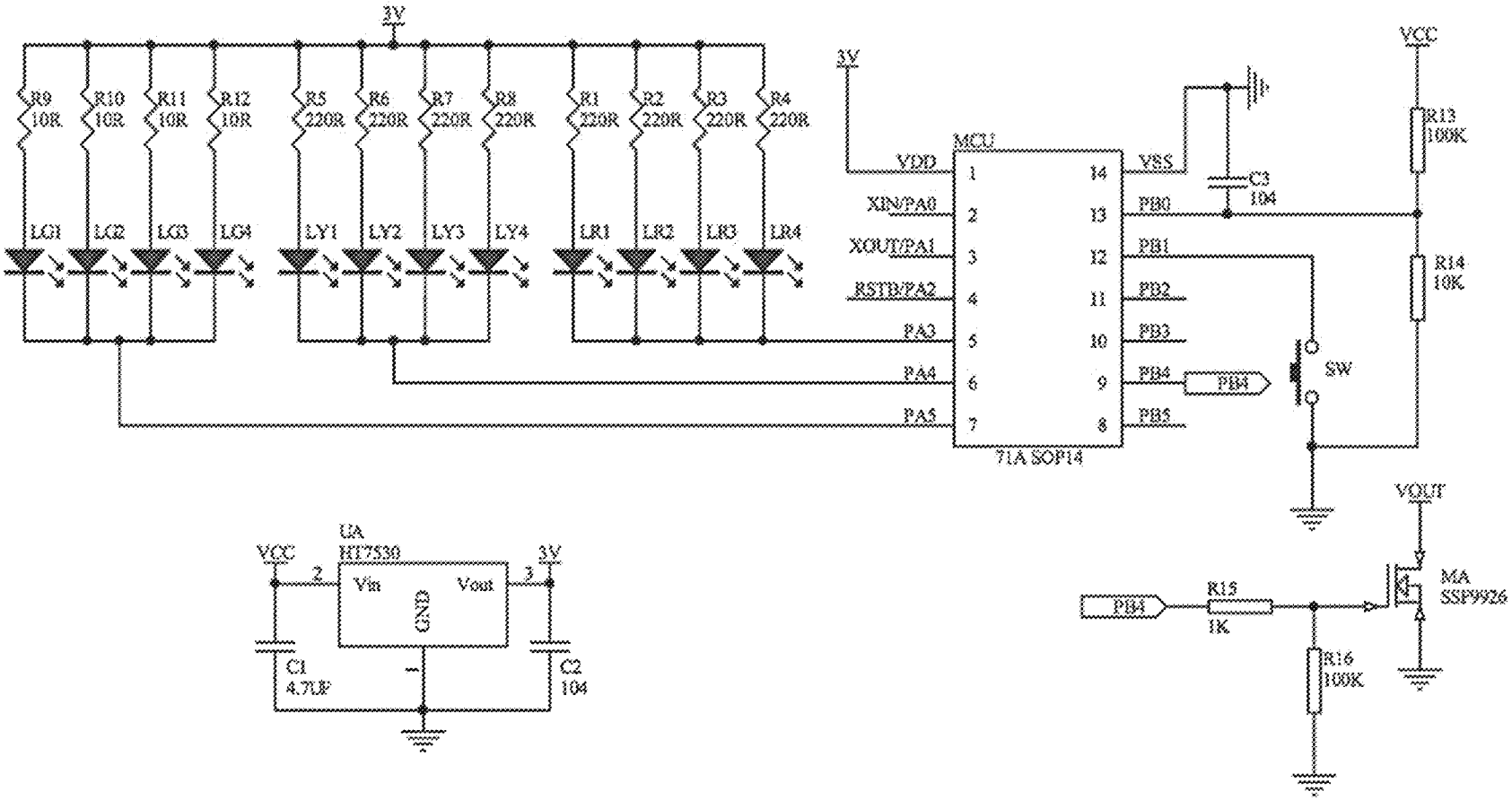
FIG. 21 is a schematic circuit diagram of an electrothermal system in the second embodiment of the present invention.
Figure 22A:
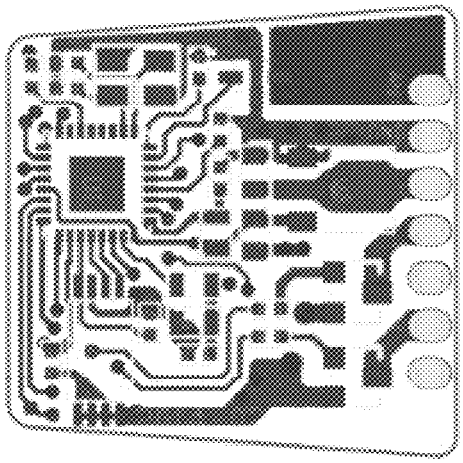
FIG. 22*a* is a schematic front view of a printed circuit board in the second embodiment of the present invention.
Figure 22B:
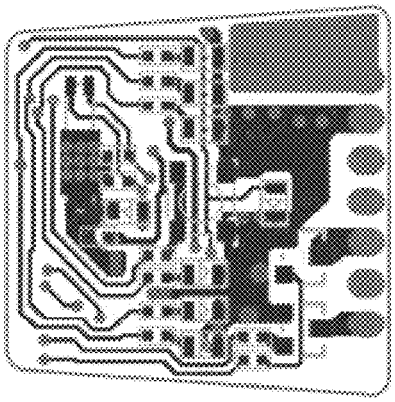
FIG. 22*b* is a schematic back view of the printed circuit board in the second embodiment of the present invention.

Referring to FIG. 20, there are shown circuit designs of an MCU having a Bluetooth 4.0 of this embodiment. A specific program is complied to communicate with a mobile terminal via the Bluetooth. As shown, CON1 is a program-hardware interface, and SO-8 is a program storage IC, which mainly function to facilitate the connection and communication between software and hardware. FIG. 21 shows how to independently operate the electrothermal product by controlling the function temperature and the output power. The MCU stores specific control programs. PB4 is the load output, and how many groups of load output to be outputted is set according to the design; and optionally, 4 groups of load output may be preset to be outputted. A voltage regulating circuit and an LED indicator are also shown in FIG. 21. FIG. 22*a* is a schematic front view of a printed circuit board, and FIG. 22*b* is a schematic back view of the printed circuit board.

It should be understood by those skilled in the art that, the embodiments of this application may be embodied as a method, a system, or a computer program product. Accordingly, the embodiments of this application may take the form of an entirely hardware embodiment, an entirely software embodiment, or an embodiment combining software and hardware. Furthermore, this application may take the form of a computer program product implemented on one or more of the computer-usable storage mediums (including but not limited to hard disk memories, CD-ROMs, optical memories and etc.) comprising computer-usable program codes.

This application has been described with reference to flowchart diagrams and/or block diagrams of methods, apparatuses (systems), and computer program products of the embodiments of this application. It should be understood that, each process flow and/or block of the flowchart diagrams and/or block diagrams, and combinations of process flows and/or blocks in the flowchart diagrams and/or block diagrams can be implemented by computer program instructions. These computer program instructions may be provided to a processor of a general purpose computer, a special purpose computer, an embedded handler or other programmable data processing apparatuses to produce a machine so that the instructions, which are executed by the processor of the computer or other programmable data processing apparatuses, create a device for implementing the functions specified in one or more of the process flows of the flowchart diagrams and/or one or more of the blocks of the block diagrams.

These computer program instructions may also be stored in a computer-readable memory that can direct a computer or other programmable data processing apparatus to function in a particular manner such that the instructions stored in the computer-readable memory produce an article of manufacture including an instruction device which implements the function specified in one or more of the process flows of the flowchart diagrams and/or one or more of the blocks of the block diagrams.

These computer program instructions may also be loaded into a computer or other programmable data processing apparatuses to cause a series of operational steps to be performed on the computer or other programmable apparatuses to produce a computer implemented process, such that the instructions executed on the computer or other programmable apparatuses provide steps for implementing the functions specified in one or more of the process flows of the flowchart diagrams and/or one or more of the blocks of the block diagrams.

Although preferred embodiments of this application have been described herein, those skilled in the art can make additional alternations and modifications to these embodiments once having known the basic inventive concept. Accordingly, the appended claims are intended to be construed as including the preferred embodiments and all alternations and modifications that shall fall within the scope of this application.

Obviously, those skilled in the art can make various changes and variations to this application without departing from the spirit and scope of this application. This application is also intended to include these alternations and variations if these modifications and variations are within the scope of the appended claims and the scope of similar technologies.

The invention claimed is:

1. An adaptive electrothermal system, comprising a controller, a step-down regulator, a power controller and a load, wherein an input of the controller is configured to receive an input voltage, a first output of the controller is configured to output an input voltage higher than an operating voltage of the load to the step-down regulator, a second output of the controller is configured to output an input voltage lower than or equal to the operating voltage of the load to the power controller, the step-down regulator steps the received input voltage down to a voltage equal to the operating voltage of the load and outputs the stepped-down voltage to the power controller, and the power controller outputs the input voltage it receives to the corresponding load according to a load control signal from the controller.

2. The adaptive electrothermal system of claim 1, further comprising at least one power source which has an output connected with the input of the controller.

3. The adaptive electrothermal system of claim 2, wherein the operating voltage of the load ranges or between 3.2V~48V, or wherein a voltage of the power source ranges between 3.2V~48V.

4. The adaptive electrothermal system of claim 1, further comprising at least one power source protection circuit in one-to-one correspondence to the at least one power source, and each of the at least one power source protection circuit is connected in series between the corresponding power source and the input of the controller.

5. The adaptive electrothermal system of claim 1, further comprising a plurality of solar elements, and an output of each of the solar elements is connected with the input of the controller or with the input of the power source.

6. The adaptive electrothermal system of claim 1, further comprising a microprocessor, a plurality of heating zones and at least one heating module, the heating zones are each provided with a connector connected with the output of the step-down regulator of the adaptive electrothermal system, the heating module matches with the heating zones, an input of the heating module is adapted to the connectors of the heating zones, and an output of the microprocessor transmits a heating zone temperature control signal to a control terminal of the connector.

7. The adaptive electrothermal system of claim 6, wherein the heating module comprises a thermal viscous fabric layer and a heat diffusion layer attached together and heating wires, heating paste or heating track sandwiched between the thermal viscous fabric layer and the heat diffusion layer.

8. The adaptive electrothermal system of claim 6, wherein the microprocessor receives the heating zone temperature control signal transmitted by a mobile terminal via a wireless and/or Bluetooth module.

9. The adaptive electrothermal system of claim 7, wherein the mobile terminal performs a filtering search for an electrothermal system and connects to the electrothermal system found to generate a corresponding heating zone temperature control signal.

10. The adaptive electrothermal system of claim 6, wherein the microprocessor receives an environment temperature sensed by a temperature sensor to generate a heating zone temperature control signal.

11. The adaptive electrothermal system of claim 6, wherein the heating zone temperature control signal is a switching pulse signal in which a rising edge signal is transmitted until the corresponding heating module reaches a preset temperature, and then a falling edge signal is transmitted.

12. The adaptive electrothermal system of claim 6, wherein the heating zone temperature control signal comprises a temperature value which is targeted to reach and a desired time period of heating, the temperature value is represented in the form of Celsius or Fahrenheit temperature values.

13. The adaptive electrothermal system of claim 6, further comprising a display panel, and the display panel has an input thereof connected with an output of the microprocessor so as to display temperatures of the heating zones.

14. The adaptive electrothermal system of claim 6, further comprising a button, and the button has an output thereof connected with the input of the microprocessor to input desired temperature values targeted to reach by the heating zones respectively.

15. The adaptive electrothermal system of claim 14, wherein arrows indicating a temperature increase or decrease, a temperature range and/or a temperature value are labeled on the button.

16. The adaptive electrothermal system of claim 6, further comprising a memory, which has an input thereof connected with the output of the microprocessor to store the turn-on/off time, a temperature of the electrothermal system, time corresponding to the operation temperature and a type of the electrothermal system.

17. An electrothermal apparel, comprising a body of the apparel and the adaptive electrothermal system of claim 1, wherein the electrothermal system is filled in the body of the apparel.

18. The electrothermal apparel of claim 17, wherein the body of the apparel comprises a microprocessor, a plurality of heating zones and at least one heating module, the heating zones are each provided with a connector connected with the output of the step-down regulator of the adaptive electrothermal system, the heating module matches with the heating zones, an input of the heating module is adapted to the connectors of the heating zones, and an output of the microprocessor transmits a heating zone temperature control signal to a control terminal of the connector.

19. The electrothermal apparel of claim 18, wherein the heating module comprises a thermal viscous fabric layer and a heat diffusion layer attached together and heating wires, heating paste or heating track sandwiched between the thermal viscous fabric layer and the heat diffusion layer.

20. The electrothermal apparel of claim 18, wherein the heating module further comprises a heat insulation layer attached to the bottom of the heat diffusion layer.

21. The electrothermal apparel of claim 20, wherein the heating module further comprises an elastic layer, and a bottom of the heat insulation layer is adhered on the elastic layer.

22. The electrothermal apparel of claim 18, wherein the microprocessor receives the heating zone temperature control signal transmitted by a mobile terminal via a wireless and/or Bluetooth module.

23. The electrothermal apparel of claim 22, wherein the mobile terminal performs a filtering search for an electrothermal apparel and connects to the electrothermal apparel found to generate a corresponding heating zone temperature control signal.

24. The electrothermal apparel of claim 18, wherein the microprocessor receives an environment temperature sensed by a temperature sensor to generate a heating zone temperature control signal.

25. The electrothermal apparel of claim 18, wherein the heating zone temperature control signal is a switching pulse signal in which a rising edge signal is transmitted until the corresponding heating module reaches a preset temperature, and then a falling edge signal is transmitted.

26. The electrothermal apparel of claim 18, wherein the heating zones include a collar, a sleeve mid-section, a sleeve elbow, a shoulder portion, a chest portion, a belly portion, a knee portion, a thigh portion, a buttock portion, a sleeve cuff portion, an upper back portion, a lower back portion and/or portions corresponding to other human body portions.

27. The electrothermal apparel of claim 18, wherein the heating zone temperature control signal comprises a temperature value which is targeted to reach and a desired time period of heating, the temperature value is represented in the form of Celsius or Fahrenheit temperature values.

28. The electrothermal apparel of claim 18, further comprising a display panel embedded into an outer surface of the body of the products or apparel, and the display panel has an input thereof connected with an output of the microprocessor so as to display temperatures of the heating zones.

29. The electrothermal apparel of claim 18, further comprising a button embedded into the outer surface of the body of the apparel, and the button has an output thereof connected with the input of the microprocessor to input desired temperature values targeted to reach by the heating zones respectively.

30. The electrothermal apparel of claim 29, wherein arrows indicating a temperature increase or decrease, a temperature range and/or a temperature value are labeled on the button.

31. The electrothermal apparel of claim 18, further comprising a memory, which has an input thereof connected with the output of the microprocessor to store the turn-on/off time, a temperature of the electrothermal apparel, time corresponding to the operation temperature and a type of the electrothermal apparel.

32. The electrothermal apparel of claim 29, wherein the light display on the button can be disabled or turned off by double-clicking on the button or received the index signal by the mobile terminal.

* * * * *